US005433629A

United States Patent [19]

Yagi et al.

[11] Patent Number: 5,433,629

[45] Date of Patent: Jul. 18, 1995

[54] FEMALE TERMINAL

[75] Inventors: Sakai Yagi; Keishi Jinno, both of Shizuoka, Japan

[73] Assignee: Yazaki Corporation, Tokyo, Japan

[21] Appl. No.: 183,804

[22] Filed: Jan. 21, 1994

[30] Foreign Application Priority Data

Jan. 21, 1993 [JP] Japan ..... 5-008276

[51] Int. Cl.[6] ..... H01R 13/187

[52] U.S. Cl. ..... 439/843; 439/845

[58] Field of Search ..... 439/843-848, 439/849, 852, 856

[56] References Cited

U.S. PATENT DOCUMENTS 5,226,842 6/1993 Endo et al. ..... 439/843

FOREIGN PATENT DOCUMENTS 58-87789 5/1983 Japan .

*Primary Examiner*—Eugene F. Desmond

*Attorney, Agent, or Firm*—Sughrue, Mion, Zinn, Macpeak & Seas

[57] ABSTRACT

To provide a female terminal in which the strength of an electrical contact portion of a tubular shape having a rectangular cross-section is enhanced, thereby preventing the terminal from being deformed during the manufacture of the terminal. In the female terminal, ears of a contact spring piece, provided within the electrical contact portion of a tubular shape having a rectangular cross-section, are engaged respectively in window holes formed respectively in side walls of the electrical contact portion. Elongate reinforcement projections or reinforcement grooves subjected to work hardening are provided at the side walls of the electrical contact portion, and extend in a direction of the height of the side walls, the projections or the grooves being provided on opposite sides of each of the window holes, respectively.

7 Claims, 4 Drawing Sheets

FEMALE TERMINAL

BACKGROUND OF THE INVENTION

1. Field of Invention

This invention relates to a female terminal in which an electrical contact portion of a tubular shape having a rectangular cross-section is enhanced in strength, thereby preventing deformation during the manufacture of the terminal.

2. Related Art

FIG. 6 shows a conventional female terminal.

This female terminal 16 comprises a terminal body 18, which has at one end portion thereof an electrical contact portion 17 of a tubular shape having a rectangular cross-section and a wire connection portion 9 at the other end portion, and a separate contact spring piece 5 provided within the electrical contact portion 17. The spring piece 5 has at its central portion ears 6 which are loosely engaged respectively in window holes 7 formed respectively in side walls 3 of the electrical contact portion 17, so that the spring piece 5 is retained so as to be flexed upwardly and downwardly.

The female terminal 16 is manufactured as shown in FIGS. 7 to 11. Namely, in a condition in which the two side walls 3 are opened away from each other as shown in FIGS. 7 and 8, the spring piece 5 connected to a link band 14 is placed in the electrical contact portion 17, and the side walls 3 are pressed toward each other by a jig 19, so that the ears 6 of the spring piece 5 are received in the window holes 7, respectively. Then, the link band 14 for the spring piece 5 is cut, and as shown in FIGS. 9 and 10, distal end portions of the upright side walls 3 are bent by an inclined jig 20 and a horizontal jig 21 to form a top wall 12. Thus, there is obtained the electrical contact portion 17 of a tubular shape having a rectangular cross-section, with the ears 6 of the spring piece 5 loosely engaged respectively in the window holes 7 for upward and downward movement.

In the above conventional female terminal 16, however, the large window holes 7 for allowing the flexing of the spring piece 5 are formed respectively through the side walls 3 of the electrical contact portion 17, and therefore when the side walls are pressed from the upper side to form the top wall 12 during the manufacture (FIG. 10), the side walls 3 are liable to be curved outwardly, which results in a problem that the ears 6 are disengaged respectively from the window holes 7, so that the spring piece 5 drops.

SUMMARY OF THE INVENTION

With the foregoing in view, it is an object of this invention to provide a female terminal in which an electrical contact portion will not be deformed by bending or the like during the manufacture of the terminal, thereby preventing a spring piece from being disengaged.

In order to achieve the above object, the present invention provides a female terminal wherein ears of a contact spring piece, provided within an electrical contact portion of a tubular shape having a rectangular cross-section, are engaged respectively in window holes formed respectively in side walls of the electrical contact portion, wherein elongate reinforcement projections or reinforcement grooves subjected to work hardening are provided at the side walls of the electrical contact portion, and extend in a direction of the height of the side walls, the projections or the grooves being provided on opposite sides of each of the window holes, respectively.

A flexural rigidity of the side walls of the electrical contact portion is increased by the elongate reinforcement projections or the work-hardening reinforcement grooves provided at these side walls, and the terminal is prevented from being deformed during the manufacture of the terminal.

DETAILED DESCRIPTION OF THE PREFERRED EMBODIMENTS

Figure 1:
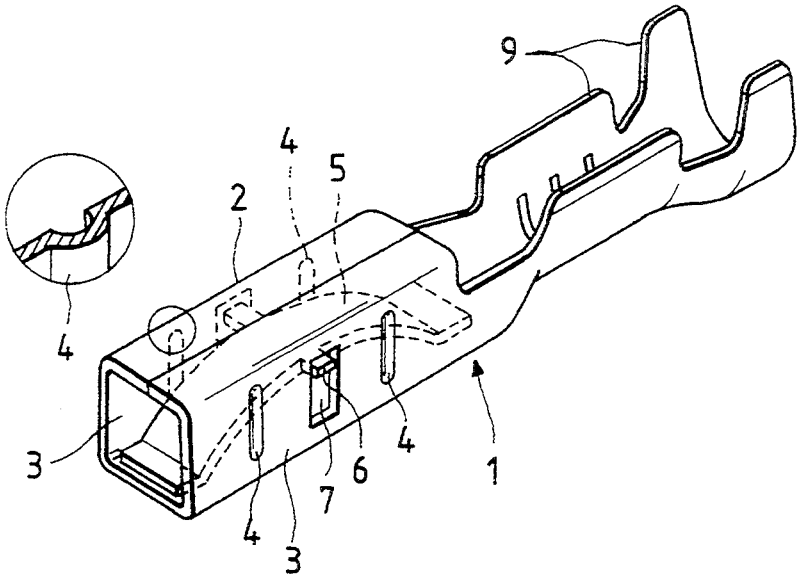
FIG. 1 is a perspective view of one preferred embodiment of a female terminal of the present invention, the inside of a circle being an enlarged fragmentary cross-sectional view of an important portion.
Figure 2:
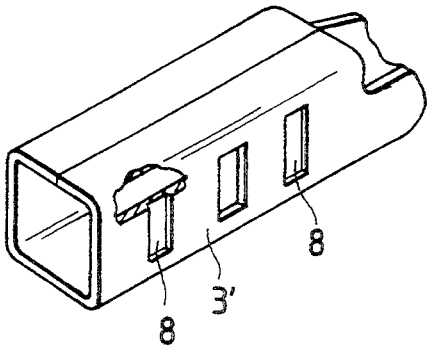
FIG. 2 is a perspective view of an important portion of another embodiment.

FIG. 1 shows one preferred embodiment of a female terminal of the present invention.

The female terminal 1 has a pair of elongate reinforcement projections 4 and 4 formed on each of opposite side walls 3 and 3 of an electrical contact portion 2 of a tubular shape having a rectangular cross-section, the elongate projections extending in the direction of the height. The pair of elongate projections 4 and 4 are formed by stamping respectively on opposite sides of an engagement window hole 7 for an ear 6 of a contact spring 5 which hole is formed through a central portion of the side wall, the elongate projections being parallel to each other. It is preferred that the projections 4 be formed in the vicinity of the window hole 7, and the number of the elongate projections is not limited to a pair, and more than two elongate projections may be provided in a juxtaposed manner.

In this embodiment, in view of the ability of the terminal to be inserted into a terminal receiving chamber of a connector housing (not shown), the elongate projections 4 are stamped toward the inside of the electrical contact portion 2. The stamped elongate projections 4 may be replaced by reinforcement grooves 8 and 8 which are formed in each side wall 3' by an impact press or the like in such a manner as to cause work hardening of these reinforcement grooves.

Figure 3:
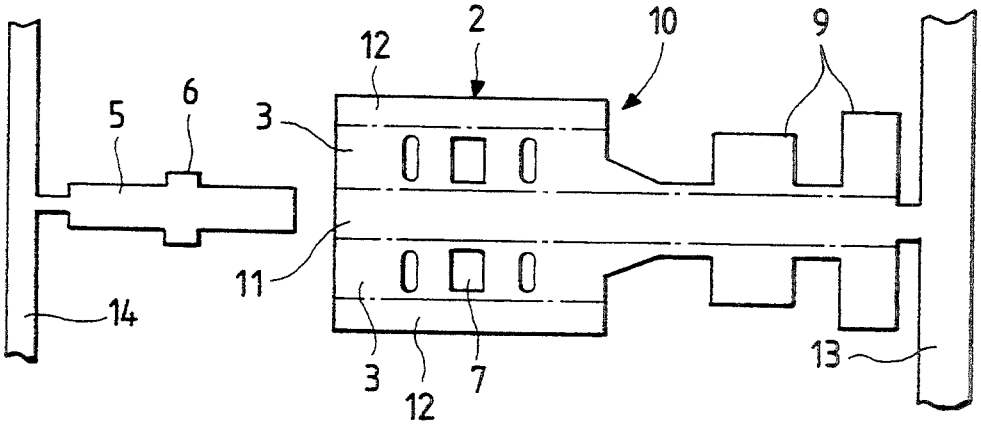
FIG. 3 is a developed view of a terminal.

The elongate reinforcement projections 4 are formed by stamping simultaneously when the terminal in a developed form is obtained from a single electricallyconductive metal plate in a blanking step, as shown in FIG. 3. In FIG. 3, reference numeral 9 denotes a wire connection portion of a terminal body 10, reference numeral 2 the electrical contact portion, reference numeral 11 a bottom wall, reference numeral 3 the side wall, and reference numeral 12 a top wall. The elongate projections 4 on each side wall 3 are provided on opposite sides of the window hole 7, respectively, and extend transversely of the side wall 3. A link band 13 interconnects a plurality of terminals 1, and the spring pieces 5 interconnected by a link band 14 are stamped out separately from the terminal body 10.

Figure 4:
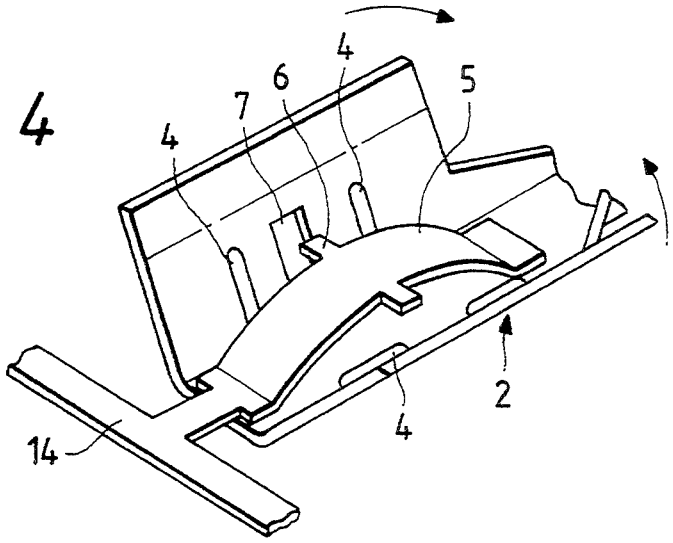
FIG. 4 is a perspective view showing a process of mounting a spring piece during the manufacture.
Figure 5:
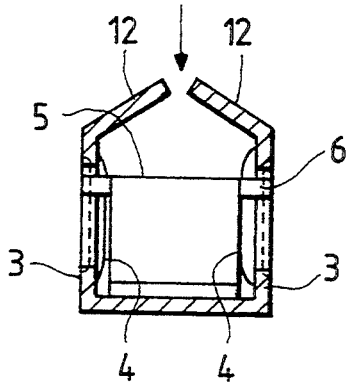
FIG. 5 is a vertical cross-sectional view showing a process of bending a top wall of an electrical contact portion.
Figure 6:
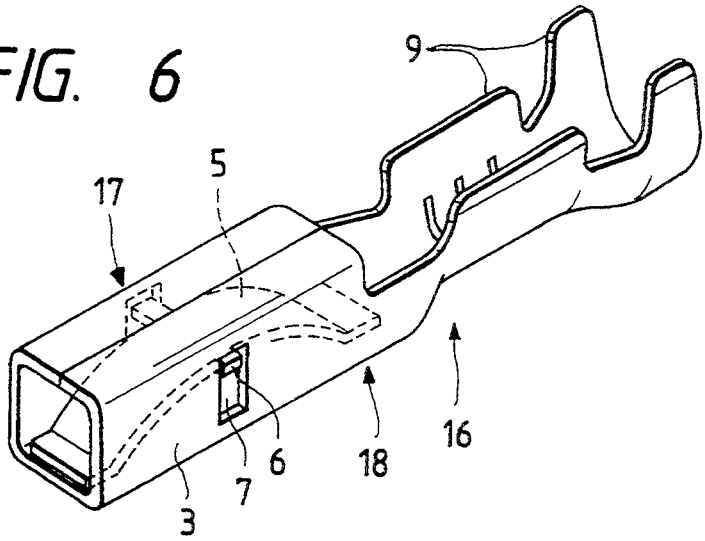
FIG. 6 is a perspective view of a conventional female terminal.
Figure 7:
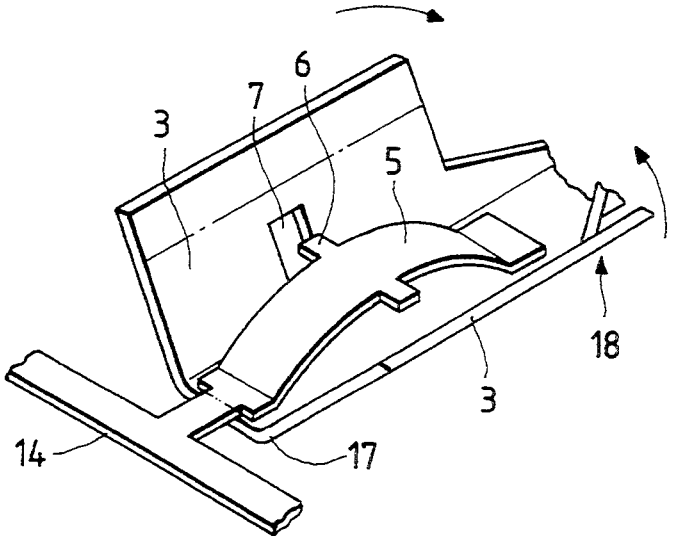
FIG. 7 is a perspective view a process of mounting a spring piece during the manufacture.
Figure 8:
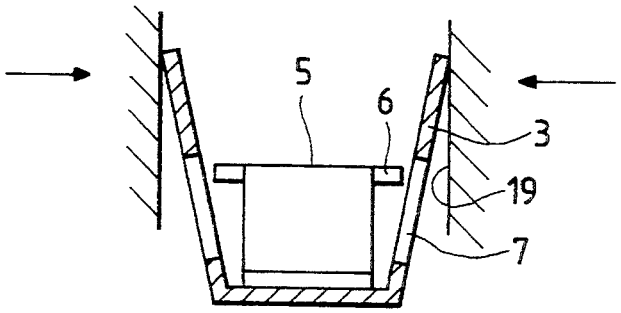
FIG. 8 is a vertical cross-sectional view showing the same condition as shown in FIG. 7.
Figure 9:
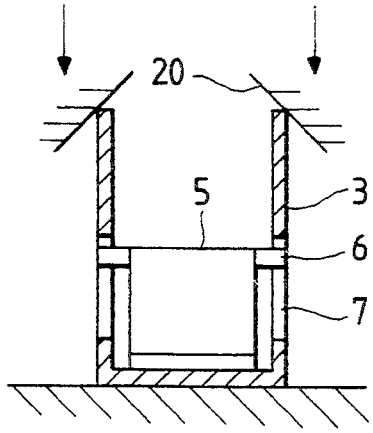
FIG. 9 is a vertical cross-sectional view showing a condition in which a top wall of an electrical contact portion is to be bent.
Figure 10:
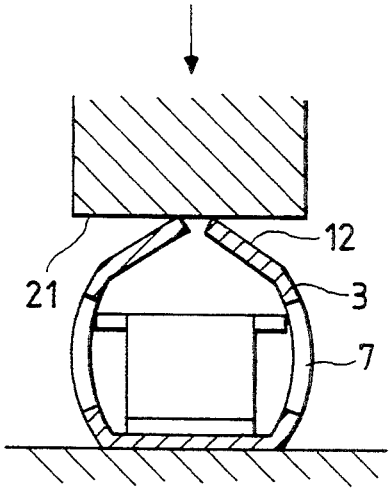
FIG. 10 is a vertical cross-sectional view showing a process of bending the top wall.
Figure 11:
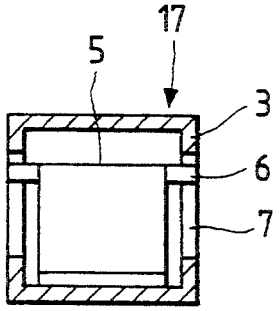
FIG. 11 is a vertical cross-sectional view showing a completed condition.

As shown in FIG. 4, the spring piece 5 is placed in the electrical contact portion 2 as in the conventional construction, and in this condition the side walls 3 of the electrical contact portion 2 are bent. Further, the side walls are pressed from the upper side to be bent to form the top wall 12, as shown in FIG. 5. At this time, the elongate reinforcement projections 4 extending in the direction of the height of the side walls 3 exhibit a high flexural rigidity to prevent the side walls 3 from being curved, thereby preventing the spring piece 5 from dropping. This effect can be similarly obtained in the case where the reinforcement grooves 8 subjected to work hardening are used instead of the elongate projections 4.

As described above, in the present invention, the elongated reinforcement projections or the reinforcement grooves, provided at the side walls of the electrical contact portion of a tubular shape having a rectangular cross-section, prevent the reduction of flexural rigidity of the side wall due to the window hole, and therefore the spring piece will not be disengaged, and defective products are prevented from being produced.

What is claimed is:

1. A female terminal comprising:

a terminal body including:

a wire connection portion;

an electrical contact portion having a bottom wall, side walls, and top walls;

a spring member accommodated in the electrical contact portion, the spring member having a pair of ears that are loosely engaged respectively in the window holes formed respectively in the side walls of the electrical contact portion; and reinforcement means for reinforcing the side walls of the electrical contact portion, the reinforcement means being provided nearby each of the window holes, respectively, and comprising grooves in the side walls.

2. The female terminal as claimed in claim 1, wherein the grooves are elongate and extend in a direction of the height of the side walls.

3. The female terminal as claimed in claim 1, wherein the grooves are work hardened in a direction of the height of the side walls.

4. The female terminal as claimed in claim 1, wherein the grooves are formed in an outer wall surface of the side walls.

5. The female terminal as claimed in claim 1, wherein portions of the side walls having the grooves are substantially semi-circular in cross section.

6. The female terminal as recited in claim 1, wherein the grooves are disposed on opposite sides of the window holes.

7. The female terminal as recited in claim 1, wherein the grooves form projections which protrude from an inner wall surface of the side walls toward the interior of the terminal body.

* * * * *